US007314014B2

(12) United States Patent
Heyring et al.

(10) Patent No.: US 7,314,014 B2
(45) Date of Patent: Jan. 1, 2008

(54) WATER CRAFT

(75) Inventors: Christopher Brian Heyring, Eagle Bay (AU); Michael Longman, Dunsborough (AU)

(73) Assignee: Heyring Technologies Pty Ltd., Margaret River WA (AU)

( * ) Notice: Subject to any disclaimer, the term of this patent is extended or adjusted under 35 U.S.C. 154(b) by 96 days.

(21) Appl. No.: 10/524,499

(22) PCT Filed: Aug. 14, 2003

(86) PCT No.: PCT/AU03/01028

§ 371 (c)(1),
(2), (4) Date: Sep. 28, 2005

(87) PCT Pub. No.: WO2004/016497

PCT Pub. Date: Feb. 26, 2004

(65) Prior Publication Data

US 2006/0144311 A1 Jul. 6, 2006

(30) Foreign Application Priority Data

Aug. 14, 2002 (AU) ..... 2002950750
Feb. 26, 2003 (AU) ..... 2003900852

(51) Int. Cl.
*B63B 1/00* (2006.01)
*B63B 1/22* (2006.01)

(52) U.S. Cl. ..... 114/61.15; 114/284

(58) Field of Classification Search ..... 114/61.15, 114/61.1, 284
See application file for complete search history.

(56) References Cited

U.S. PATENT DOCUMENTS 1,344,903 A 6/1920 Koiransky
2,991,746 A * 7/1961 Cunningham ..... 114/283
3,146,752 A * 9/1964 Ford ..... 114/67 A
3,265,026 A * 8/1966 Hamilton ..... 114/61.19
3,922,994 A 12/1975 De Long
5,097,916 A 3/1992 Brandstadter
5,592,894 A 1/1997 Johnson
5,799,603 A 9/1998 Tellington
6,270,098 B1 8/2001 Heyring et al.

FOREIGN PATENT DOCUMENTS

AU 87031/91 5/1992

(Continued)

*Primary Examiner*—Lars A. Olson
*Assistant Examiner*—Daniel V. Venne
(74) *Attorney, Agent, or Firm*—Occhiuti Rohlicek & Tsao LLP

(57) ABSTRACT

A water craft (77) is disclosed which includes a chassis portion (78), at least four water engaging means (30, 34, 38, 42) and interconnecting means (94, 96, 98, 100, 102, 104, 106, 108, 110, 112, 114, 116, 118, 120, 122, 124, 126, 128, 130, 132). Each water engaging means is connected to the chassis portion (78) and is moveable in a substantially vertical direction relative to the chassis portion (78), and the interconnection means is arranged to functionally link the at least four water engaging means (30, 34, 38, 42) such that during use the chassis portion is encouraged to maintain an orientation which is substantially constant relative to the average plane of the water surface, even when the water surface is undulating and the water engaging means (30, 34, 38, 42) are not all disposed in the same plane.

39 Claims, 10 Drawing Sheets

FOREIGN PATENT DOCUMENTS

| | | |
|---|---|---|
| CA | 2 119 417 | 9/1995 |
| EP | 0 102 886 | 3/1984 |
| FR | 2 451 312 | 10/1980 |
| FR | 2 541 962 | 9/1984 |
| FR | 2 546 474 | 11/1984 |
| FR | 2 607 097 | 5/1988 |
| FR | 2 678 232 | 12/1992 |
| FR | 2 766 785 | 2/1999 |
| JP | 2002-193181 | 7/2002 |
| WO | 84/01337 | 4/1984 |
| WO | 98/08732 | 3/1998 |

* cited by examiner

WATER CRAFT

FIELD OF THE INVENTION

The present invention relates to a water craft and, in particular, to displacement-type water craft and planing-type water craft.

BACKGROUND OF THE INVENTION

It is known to provide a displacement-type water craft which operates such that as the water craft moves through the water a mass of water is displaced from a front portion to a rear portion of the water craft.

At relatively low speed, the water craft is capable of moving relatively efficiently through a body of water. However, when the water craft moves relatively quickly through a body of water, the rate at which water is required to be displaced consequently increases which causes significant turbulence and a consequent loss of efficiency. This effect is increased when waves are encountered by the water craft since the water craft will cut relatively deep into the body of water when the water craft passes through a wave crest.

Furthermore, displacement-type water craft also tend to provide a passenger with an uncomfortable ride and an increased risk of sea sickness since the body of the water craft generally follows the surface of the water.

In order to overcome some of the disadvantages of displacement-type water craft, it is known to provide planing-type water craft which rise up relative to a body of water and plane across the surface of the body of water when the water craft attains sufficient speed. This allows the water craft to move much faster across the body of water using less energy than displacement-type water craft.

However, if the surface of the body of water is not relatively flat, an uncomfortable jarring motion occurs as a result of heavy impact between the water craft and each successive wave front. In relatively rough water, such planing-type water craft are unable to achieve planing speed and are compelled to move relatively slowly and inefficiently as displacement-type water craft.

A further alternative is to provide a water craft with two or more elongate narrow hulls which slice through the water more economically and more comfortably than relatively wide single hull water craft.

However, such multi hull-type water craft are prone to accident because they are of rigid construction; in some circumstances, for example in relatively rough conditions, at least one hull lifts from the water surface while the other hull(s) become submerged. As a consequence, extreme forces are localised within parts of the structure which can cause the craft to break or capsize.

In order to increase speed and comfort by reducing the contact surface area between the or each hull of the water craft and a body of water, hydrofoil-type water craft have been produced. With such hydrofoil-type water craft, submerged wings are provided such that when the water craft reaches a particular speed, the wings produce sufficient lift to raise the craft out of the water. Since the wings are completely submerged and cut through the water rather than travelling on the surface of the water, hydrofoil-type water craft require considerable engine power to raise the or each hull out of the body of water during use. In addition, the drag caused by the submerged wings causes the water craft to be very inefficient when moving slowly. Hydrofoil-type water craft are also unable to operate in relatively shallow waters as the wings and engine propellers tend to extend a few meters below the water surface when the water craft is moving slowly or is at rest.

SUMMARY OF THE INVENTION

In accordance with a first aspect of the present invention, there is provided a water craft including a chassis portion, at least four water engaging means and interconnection means,

- each water engaging means being connected to the chassis portion and being moveable in a substantially vertical direction relative to the chassis portion, and
- the interconnection means being arranged to functionally link the at least four water engaging means such that during use the chassis portion is encouraged to maintain an orientation which is substantially constant relative to the average plane of the water surface, even when the water surface is undulating and the water engaging means are not all disposed in the same plane,
- wherein the interconnection means includes a plurality of rams and a plurality of fluid conduits, each ram being associated with a water engaging means and each ram being fluidly connected to at least one other ram associated with at least one other water engaging means using at least one fluid conduit.

In one arrangement, the interconnection means is arranged to functionally link the water engaging means such that, for any loading condition, the static load on each water engaging means remains substantially constant even when the water engaging means are not all disposed in the same plane.

Preferably, the interconnection means is arranged to functionally link the water engaging means such that statically the proportion of weight borne by a first pair of oppositely located water engaging means relative to the weight borne by a second pair of oppositely located water engaging means is substantially constant.

Preferably, the interconnection means is arranged to functionally link the water engaging means such that when one of the water engaging means is urged during use to move in a generally upward vertical direction relative to the chassis portion, two adjacent water engaging means are urged to move in a generally downward vertical direction relative to the chassis portion.

In one arrangement, the water engaging means are disposed in a diamond shaped configuration relative to the chassis portion when viewed in plan.

With this arrangement, the interconnection means may be arranged to functionally link the water engaging means such that when two adjacent water engaging means are urged during use to move in the same generally upward vertical direction relative to the chassis portion, an opposite two adjacent water engaging means are restricted from moving in a generally downward vertical direction relative to the chassis portion.

In an alternative arrangement, the water engaging means are disposed in a rectangular shaped configuration relative to the chassis portion when viewed in plan.

With this arrangement, the interconnection means may be arranged to functionally link the water engaging means such that when two adjacent water engaging means disposed on a first lateral side of the water craft are urged during use to move in a generally upward vertical direction relative to the chassis portion, two adjacent water engaging means disposed on a second opposite lateral side of the water craft are restricted from moving in a generally downward vertical direction relative to the chassis portion.

In one variation, two adjacent water engaging means disposed on the first lateral side are functionally linked to a transversely oppositely located two adjacent water engaging means disposed on the second lateral side.

In an alternative variation, two adjacent water engaging means disposed on the first lateral side are functionally linked to a diagonally oppositely located two adjacent water engaging means disposed on the second lateral side.

Preferably, at least two water engaging means are each associated with two rams, each ram being fluidly connected to at least one other ram associated with at least one other water engaging means.

Preferably, the rams and fluid conduits define a plurality of discrete fluid circuits, at least some of the fluid circuits including a first fluid circuit portion extending between upper chambers of two adjacent rams, and at least some of the fluid circuits including a second fluid circuit portion extending between lower chambers of the two adjacent rams.

The water engaging means may by disposed in a diamond shaped configuration relative to the chassis portion when viewed in plan, and with this configuration at least some of the fluid circuits may include a third fluid circuit portion extending between a first fluid circuit portion of a first pair of adjacent rams and a second fluid circuit portion of an oppositely located pair of adjacent rams.

The water engaging means may be disposed in a rectangular shaped configuration relative to the chassis portion when viewed in plan, and with this configuration at least some of the fluid circuits may include a third fluid circuit portion extending between a first fluid circuit portion of a first pair of adjacent rams disposed on a first lateral side of the water craft and a second fluid circuit portion of a diagonally oppositely located pair of adjacent rams disposed on a second lateral side of the water craft.

Alternatively, the water engaging means may be disposed in a rectangular shaped configuration relative to the chassis portion when viewed in plan, and with this configuration at least some of the fluid circuits may include a third fluid circuit portion extending between a first fluid circuit portion of a first pair of adjacent rams disposed on a first lateral side of the water craft and a second fluid circuit portion of a transversely oppositely located pair of adjacent rams disposed on a second lateral side of the water craft.

Preferably, the water craft further includes at least one accumulator in fluid communication with at least one of the fluid circuits and/or at least one damper valve.

In one arrangement, the at least one damper valve is a controllable damper valve arranged to provide an adjustable level of damping. The controllable damper valve may be arranged such that fluid flow through a fluid circuit during use effects relative movement between a magnetic member and a coil and thereby generation of an electrical current, the degree of damping provided by the controllable damper valve being proportional to the magnitude of electrical power drawn from the coil.

The controllable damper valve may include a gear motor in circuit with a fluid circuit, the gear motor being arranged to turn when fluid flows in the fluid circuit, and a generator having a rotor caused to rotate when the gear motor rotates and to thereby generate an electrical current.

Alternatively, the controllable damper valve may include a piston portion and a cylinder portion, one of the piston portion and the cylinder portion being arranged to generate a magnetic field and the other of the piston portion and the cylinder portion including a coil, the piston portion being arranged to move relative to the cylinder portion when fluid flows in the fluid circuit so as to thereby generate an electrical current in the coil.

Preferably, the water craft further includes means for controlling the orientation of the water engaging means relative to the average plane of the water surface. The means for controlling the orientation of the water engaging means includes at least one control ram and at least one sensor arranged to sense a parameter associated with operation of the water craft and to cause expansion or contraction of at least one control ram in response to the at least one sensor. The parameter associated with operation of the water craft may be lateral force, pitch force, yaw force, or steering position.

Preferably, at least one of the water engaging means is connected to the chassis portion using a double wishbone.

Preferably, at least one of the water engaging means includes an underside surface arranged to contact the water surface during use, the underside surface being contoured so as to restrict side slippage of the water craft during use.

In a preferred embodiment, the water craft includes six water engaging means disposed in a rectangular configuration such that three water engaging means are disposed on a left side of the water craft and three water engaging means are disposed on a right side of the water craft. In alternative embodiment, 8, 10 or more water engaging means are provided.

The water craft may include at least one damping means arranged to absorb energy from motions of at least one water engaging means relative to the chassis, with each damping means being associated with a water engaging means and each damping means including a first damping member and a second damping member arranged to move relative to the first damping member when the water engaging means moves relative to the chassis, the damping means being arranged such that relative movement between the first damping member and the second damping member effects relative movement between a magnetic member and a coil and thereby generation of an electrical current, the degree of damping provided by the controllable damper valve being proportional to the magnitude of electrical power drawn from the coil.

The damping means may include a piston portion and a cylinder portion, one of the piston portion and the cylinder portion being arranged to generate a magnetic field and the other of the piston portion and the cylinder portion including a coil, the piston portion being arranged to move relative to the cylinder portion when a water engaging means moves relative to the chassis portion so as to thereby generate an electrical current in the coil.

In an alternative arrangement, the damping means may include a fluid pump and a fluid storage device, the fluid pump being arranged to transfer fluid to the fluid storage device when a water engaging means moves relative to the chassis portion.

Preferably, the water craft further includes energy storage means arranged to store at least a portion of the energy absorbed by the damping means. The energy storage means may include a battery.

In accordance with an alternative aspect of the present invention, there is provided a water craft including a chassis portion, a plurality of water engaging means, and at least one damping means, wherein each damping means is associated with a water engaging means and each damping means includes a first damping member and a second damping member arranged to move relative to the first damping member when the water engaging means moves relative to the chassis, the damping means being arranged such that relative movement between the first damping member and the second damping member causes absorption of energy from motions of at least one water engaging means relative to the chassis portion.

BRIEF DESCRIPTION OF THE DRAWINGS

The present invention will now be described, by way of example only, with reference to the accompanying drawings, in which.

DESCRIPTION OF A PREFERRED EMBODIMENT OF THE PRESENT INVENTION

Figure 1:
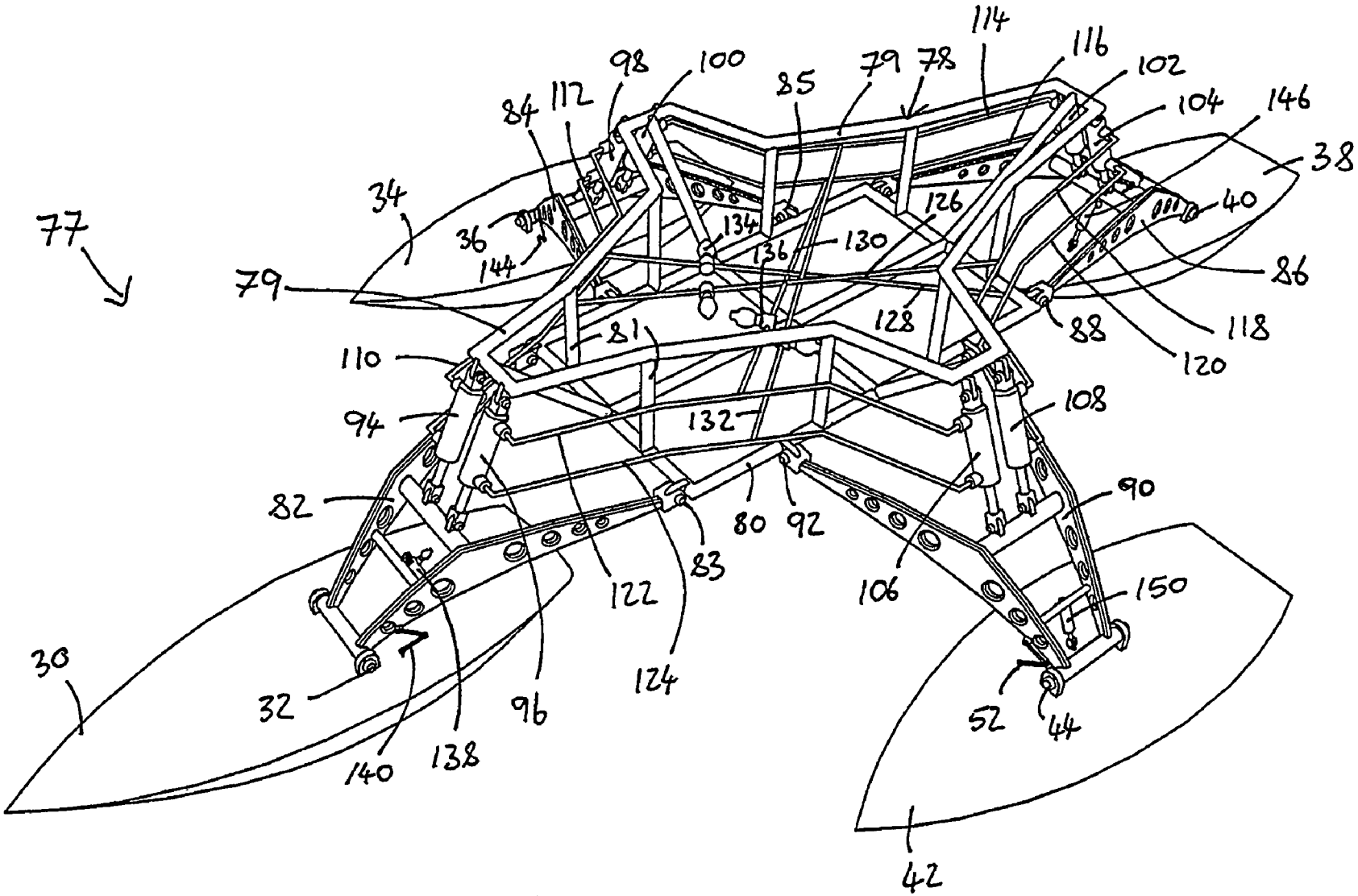
FIG. 1 is a diagrammatic perspective view of a water craft in accordance with an embodiment of the present invention.

Referring to FIGS. 1 to 4 of the drawings, there is shown a water craft 77 in accordance with an embodiment of the present invention.

The water craft 77 includes a substructure or chassis 78 having an upper chassis portion 79 and a lower chassis portion 80 connected by links 81.

A front leg 82 is pivotably connected to the lower chassis portion 80 at front leg hinge connections 83, a right side leg 84 is pivotably connected to the lower chassis portion 80 at right leg hinge connections 85, a rear leg 86 is pivotably connected to the lower chassis portion 80 at rear leg hinge connections 88, and a left side leg 90 is pivotably connected to the lower chassis portion 80 at left leg hinge connections 92.

Ends of the legs 82, 84, 86, 90 are provided with respective water engaging means which may be a ski, float or any other suitable water engaging device. In this specification, the water engaging means will be referred to as "pods" for ease of reference. In this example, ends of the front, right side, rear and left side legs 82,84, 86, 90 are provided with front, right side, rear and left side pods 30, 34, 38 and 42 respectively.

Underside surfaces 58 of the pods may be contoured depending on the required application, for example so that side slippage of the side pods during use is restricted, and so that the front and rear pods may move sideways to facilitate turning of the craft. Additionally or alternatively, fixed and/or steerable fins can be used.

Flexibly connected to and extending between the front leg 82 and the upper chassis portion 79 are a double acting front right ram 94 and a double acting front left ram 96. Flexibly connected to and extending between the right side leg 84 and the upper chassis portion 79 are a double acting right front ram 98 and a double acting right rear ram 100. Flexibly connected to and extending between the rear leg 86 and the upper chassis portion 79 are a double acting rear right ram 102 and a double acting rear left ram 104. Flexibly connected to and extending between the left side leg 90 and the upper chassis portion 80 are a double acting left front ram 106 and a double acting left rear ram 108.

In this example, each ram is a hydraulic ram, a cylinder portion of each ram being connected to the upper chassis portion 79 and a piston portion of each ram being connected to a leg. In this way, the surface area of the piston in the upper chamber of each ram is greater than the surface area of the piston in the lower chamber of each ram.

Upper chambers of the front right ram 94 and the right front ram 98 are connected together in fluid communication and lower chambers of the front right ram 94 and the right front ram 98 are connected together in fluid communication by an upper front right conduit 110 and a lower front right conduit 112 respectively. Upper chambers of the right rear ram 100 and the rear right ram 102 are connected together in fluid communication and lower chambers of the right rear ram 100 and the rear right ram 102 are connected together in fluid communication by an upper rear right conduit 114 and a lower rear right conduit 116 respectively. Upper chambers of the rear left ram 104 and the left rear ram 108 are connected together in fluid communication and lower chambers of the rear left ram 104 and the left rear ram 108 are connected together in fluid communication by an upper rear left conduit 118 and a lower rear left conduit 120 respectively. Upper chambers of the front left ram 96 and the left front ram 106 are connected together in fluid communication and lower chambers of the front left ram 96 and the left front ram 106 are connected together in fluid communication by an upper front left conduit 122 and a lower front left conduit 124 respectively.

The lower front right conduit 112 is connected in fluid communication with the upper rear left conduit 118 by a first link conduit 126. The upper front right conduit 110 is connected in fluid communication with the lower rear left conduit 120 by a second link conduit 128. The upper front left conduit 122 is connected in fluid communication with the lower rear right conduit 116 by a third link conduit 130. The lower front left conduit 124 is connected in fluid communication with the upper rear right conduit 114 by a fourth link conduit 132.

The water craft 77 also includes several accumulators 134 and damper valves 136 disposed in circuit with the conduits, the accumulators serving to absorb rapid leg movements during use, and the damper valves serving to control the rate of fluid flow so as to limit overshoot of motions and prevent the craft from bouncing excessively.

Figure 10:
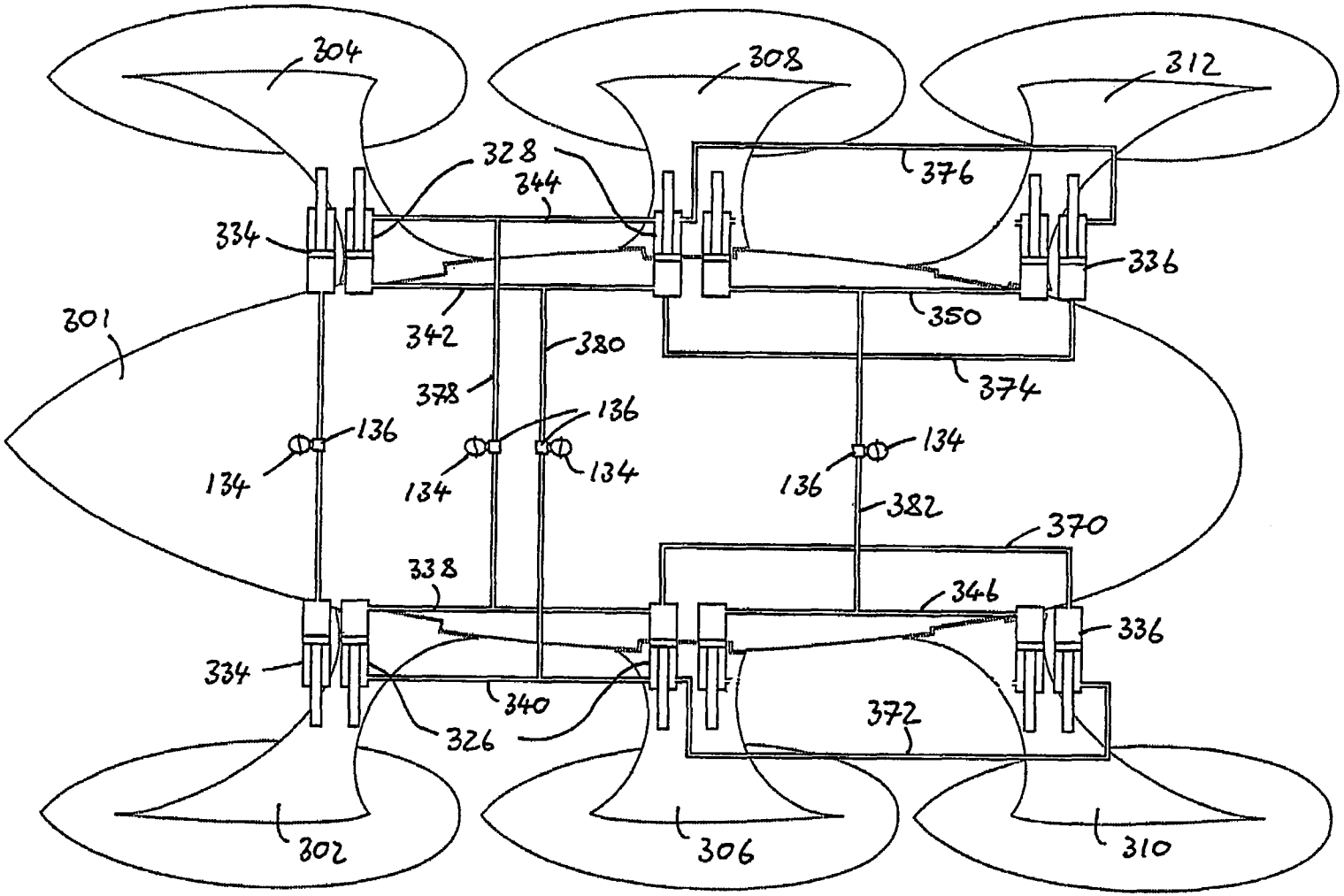
FIG. 10 is a diagrammatic plan view of a water craft in accordance with a further alternative embodiment of the present invention.

For ease of reference, the rams 94, 96, 98, 100, 102, 104, 106, 108 and interconnecting conduits 110, 112, 114, 116, 118, 120, 122, 124, 126, 128, 130, 132 are shown diagrammatically in FIG. 10. Although in this Figure no accumulators or damper valves are shown, it will be understood that in practice, accumulators and damper valves would be present.

Operation of the water craft 77 will now be described with reference to FIGS. 1 to 4. When the water craft 77 is at rest on relatively flat water, the weight of the water craft 77 is substantially equally borne by the rams which are held in compression between the upper chassis portion 79 and the legs.

Under normal conditions, piston rods of the rams would be statically adjusted such that heads of the piston rods locate generally centrally of respective ram cylinders. This ensures that an equal amount of extension and contraction of the rams is possible. The diameter and length of the piston rods as well as the amount of gas in the accumulators determines the spring rates for the craft. For example, it will be understood that an increase in spring rate may be achieved by increasing the diameter of the piston rods or by reducing the amount of gas in the accumulators.

Under normal usage, when the water craft is stationary and an additional load is applied to the water craft, the rams become additionally compressed which causes their overall length to reduce, a volume of fluid equivalent to the extra volume of piston rod introduced into the hydraulic circuits to be accommodated in the accumulators, and the volume of gas in the accumulators to reduce. In order to reset the normal optimum travelling ride height of the water craft after a load has been applied, additional fluid would be introduced into the hydraulic circuits.

If during use the front pod 30 encounters a wave crest, the front leg 82 is caused to move upwards relative to the chassis 78 thereby causing compression of the front right ram 94 and the front left ram 96. This causes an increase in fluid pressure in the upper chambers of the front right ram 94 and the front left ram 96 and a corresponding increase in fluid pressure in the upper front right conduit 110 and the upper front left conduit 122. This causes fluid to flow from the upper chambers of the front right ram 94 and the front left ram 96 to the upper chambers of the right front ram 98 and the left front ram 106. This causes the right front ram 98 and the left front ram 106 to extend as the upper chambers of these rams are enlarged to accommodate the fluid volume from the increased fluid pressure in the upper front right conduit 110 and the upper front left conduit 122. As a result, the right and left side legs 84, 90 move downwards relative to the chassis 78.

Since the right rear ram 100 and the left rear ram 108 are also connected between a respective side leg 84, 90 and the chassis 78, as the side legs 84, 90 move downwardly relative to the chassis, the right rear ram 100 and the left rear ram 108 also extend. This causes the upper chambers of the right rear ram 100 and the left rear ram 108 to enlarge and the fluid pressure in the upper chambers of these rams to reduce. This causes fluid to flow from the upper chambers of the rear right ram 102 and the rear left ram 104 to the upper chambers of the right rear ram 100 and the left rear ram 108 which permits the rear right ram 102 and the rear left ram 104 to contract under the weight of the craft. As a result, the rear leg 86 moves upwardly relative to the chassis 78 in order to substantially equalise the pressure and weight borne by each ram.

It will be understood, therefore, that each leg is provided with two double acting rams which are mechanically connected to each other and which are each hydraulically connected to a ram of an adjacent leg. As a consequence, movement of one of the legs in a generally vertical direction tends to cause movement of an adjacent leg in an opposite vertical direction, and movement of an opposite leg in the same direction.

However, when the water craft 77 is moving relatively quickly across a body of water, in order to promote a more comfortable ride, accumulators and damping valves are provided which obscure the tendency of one of the legs to cause movement of the other legs.

If during use the water craft 77 experiences a pitch and roll type force which tends to submerge adjacent pods, for example the front and right pods 30, 34, and tilt the body of the water craft, and which tends to raise the opposite pods, for example the rear and left pods 38, 42, the water craft will experience an apparent weight shift which causes the front right ram 94 and the right front ram 98 to contract and the rear left ram 104 and the left rear ram 108 to expand. Since the upper chambers of the front right ram 94 and the right front ram 98 will experience substantially the same increase in pressure and the lower chambers of the rear left ram 104 and the left rear ram 108 will experience substantially the same increase in pressure, a pressure differential is created across the pistons of the front right ram 94, the right front ram 98, the rear left ram 104 and the left rear ram 108. The increased pressure in the lower chambers of the rear left ram 104 and the left rear ram 108 urges the rear left ram 104 and the left rear ram 108 to contract so as to increase the volume of fluid in the lower chambers of the rear left ram 104 and the left rear ram 108. As a result, the rear leg 86 and the left leg 90 are urged to move upwardly relative to the chassis 78 so as to prevent a left rear portion of the chassis 78 from lifting relative to a front right portion of the chassis 78.

It will be understood, therefore, that when two or more adjacent legs of the water craft 77 are urged to move in the same generally vertical direction relative to the chassis 78, the other legs are also urged to move in the same direction.

It will also be understood that although the abovementioned hydraulic circuits act to restrict roll and pitch motions of the water craft, individual motions of the legs are not restricted. The water craft is consequently able to move in a cross-wind without keeling over whilst allowing each pod to move relative to its adjacent pods.

It will be understood that by facilitating movement of the legs as described above, the sum of the loads on the front and rear pods will, during use, be substantially equal to the loading on the pair of side pods. Consequently, the chassis 78 is encouraged to maintain a substantially stable inclination as the water craft progresses over an uneven water surface.

Although the above alternative embodiment has been described in relation to a water craft 77 which includes legs pivotably connected to a lower chassis portion 80, it will be understood that other arrangements for moveably connecting the pods to the chassis are possible. For example, the legs may be replaced by double wishbones. An advantage of this arrangement is that in addition to causing generally vertical movement of a pod, the wishbones may also be designed to cause the pod to tilt, for example so that when a pod loses contact with the water a front portion of the pod does not dig into the water on re-entry. Additionally, when the side pods move up and down through an arc relative to the chassis, the side pods may be caused to stay parallel to the craft and the average water level.

Figure 2:
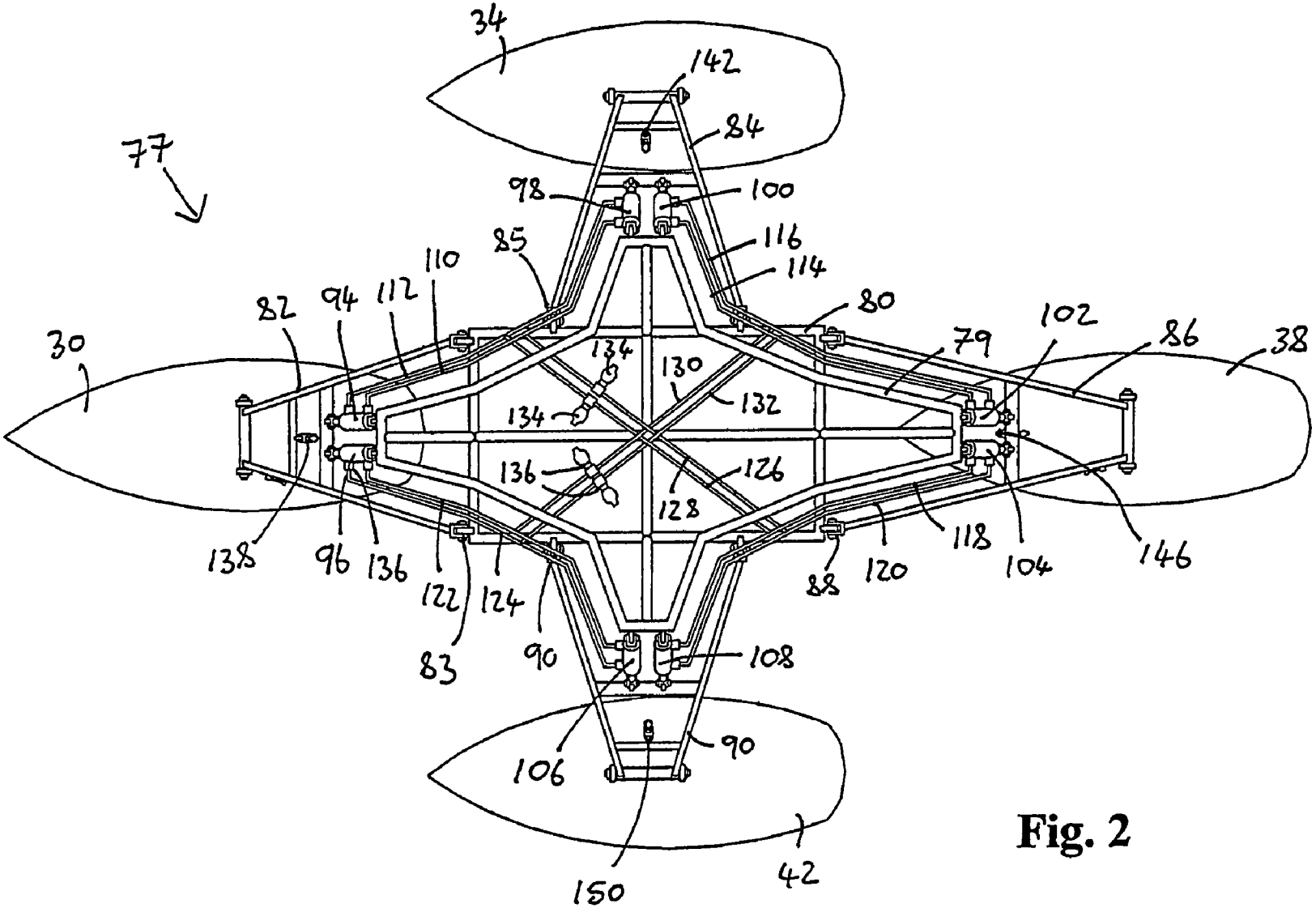
FIG. 2 is a diagrammatic plan view of the water craft shown in FIG. 1.
Figure 3:
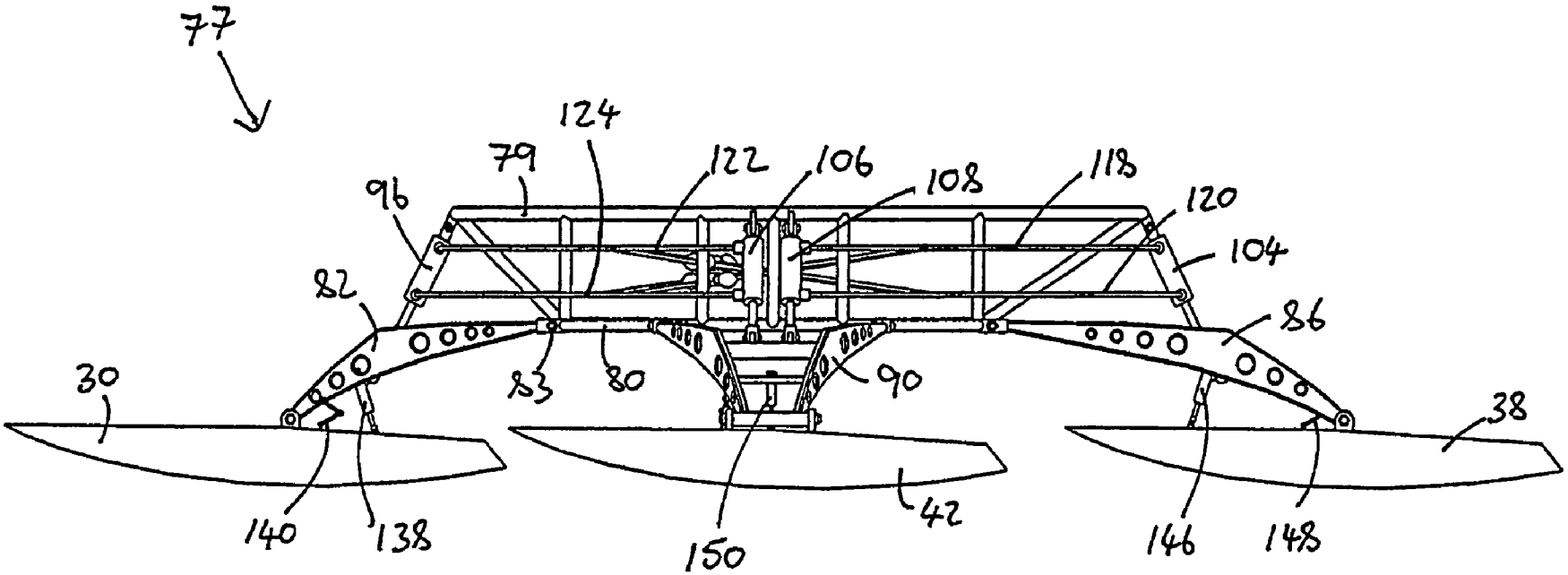
FIG. 3 is a diagrammatic side view of the water craft shown in FIGS. 1 and 2.
Figure 4:
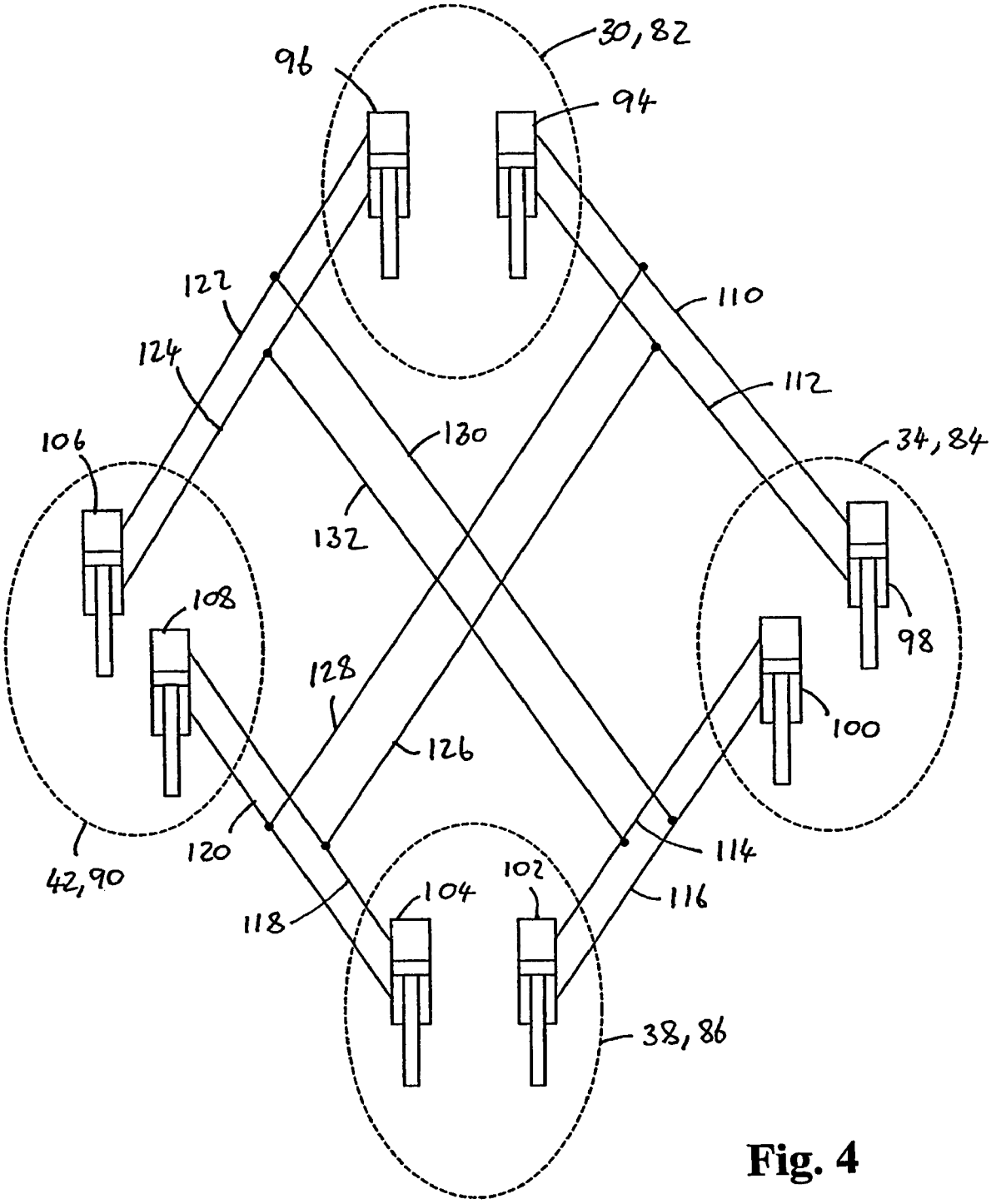
FIG. 4 is a schematic diagram illustrating operation of hydraulic circuits of the water craft shown in FIGS. 1 to 3.

As shown in FIGS. 1 to 3, each of the four discrete hydraulic circuits formed by upper chambers of an adjacent two rams, lower chambers of an adjacent opposite two rams and a conduit interconnecting the chambers in this example is provided with at least one accumulator, in this example hydraulic accumulators 134, and normally at least one damper. However, it will be understood that any number and type of accumulators and dampers may be provided depending on the level of resilience and damping required.

In one example, each accumulator 134 is provided with a damper valve adjacent a fluid entry port of the accumulator 134 to reduce the speed of fluid passing into and out of the accumulator. The damper valve also serves to facilitate control of the degree of restriction to fluid flow so as to thereby control bounce/heave.

In one example, each ram is provided with a damper valve, generally associated with an upper chamber of the ram, so as to facilitate control of movement of the rams. Two damper valves may also be disposed in circuit with each of the link conduits 126, 128, 130, 132, one damper valve being disposed adjacent each longitudinal end of a link conduit so as to facilitate specific control of roll and pitch motions.

Each accumulator 134 may be of any suitable type, such as of bladder or piston configuration and may be provided with a variable damper valve mechanism at the fluid entry port. The characteristics of the damper valves may be varied by selecting appropriate deformable shims, or by more complex needle or spool valves, or by solenoids optionally controlled using an electronic control unit (ECU) in response to signals from a plurality of sensors disposed at various locations on the water craft 77, and so on.

It will be understood that the function of the accumulators and damper valves is to provide a degree of resilience to accommodate rapid pod motions and to resolve spike loads which could cause a jarring ride and traumatise components of the water craft. In particular, the accumulators and damper valves are of primary importance when the water craft 77 is travelling relatively quickly. At relatively slow speeds, when the water craft is travelling through relatively smooth waves, the front and rear pods will tend to move together in one direction while the left and right pods tend to move together in an opposite direction with fluid being transferred between chambers of adjacent rams. However, when the water craft is travelling relatively fast and the conditions experienced by the water craft are relatively rough, instead of promoting opposite movement of diagonally opposite ram pairs, a degree of resilience is required to absorb rapid pod motions.

In the present example, the accumulators 134 and associated damper valves 136 are disposed generally centrally of the first, second, third and fourth link conduits 126, 128, 130, 132, as this location is particularly suitable for absorbing minor and rapid pod movements without undue mass effects and without excessive damping which can occur as a result of excessively long conduit paths. However, it will be understood that the accumulators may be located at other locations in the hydraulic circuits and additional accumulators and/or damping devices may be provided depending on the requirements. For example, damper valves may be provided between any of the ram chambers and the associated conduits, or in the conduits themselves.

Damping may also be accomplished using point restrictors or by narrowing any of the conduits.

The water craft 77 may also include means for controlling the orientation of the pods relative to their respective legs. For this purpose, the front pod 30 has an associated front pod ram 138 and a front pod position sensor 140, the right pod 34 has an associated right pod ram 142 and a right pod position sensor 144, the rear pod 38 has an associated rear pod ram 146 and a rear pod position sensor 148, and the left pod 42 has an associated left pod ram 150 and a left pod position sensor 152.

The pod rams 138, 142, 146, 150 control orientation of the pods relative to the legs such that the front and rear pods 30, 38 may be angled upwardly or downwardly as appropriate, and the side pods 34, 42 may be angled to one side as appropriate. For example, if the water craft becomes airborne, the front and rear pods 30, 38 may be angled upwardly so as to prevent the skis from digging into the water on landing. Also, when the water craft is turning, the side pods 34, 42 may be angled to one side so as to restrict side slippage of the water craft.

As discussed above, the roll attitude of each pod can be controlled by the geometry of the linkage means such as double wishbones which connect each pod to the chassis or main hull of the watercraft. Additionally, with some applications, for example power boats, it can be desirable to control the pitch attitude of each pod individually using pod pitch attitude adjustment means such that, as the watercraft begins to move, the pods are angled upwards at the front to assist the watercraft in rising up to a skiing position on the pods.

It will be understood that the above embodiments are for illustrative purposes only, and that in practice the chassis 12, 74, 78 would be enclosed by a body formed of any appropriate material such as plastics, direct or caste GRP, foam sandwich, roto moulded plastics or aluminium, and so on. The legs and pods could also be constructed of any appropriate material such as plastics, plastics incorporating carbon fibre or fibreglass with or without foam infills, foam sandwich, and so on. Larger craft may be provided with legs, a body and pods which incorporate truss members of alloy material such as 6061T6 so as to provide strength and rigidity. Such truss members may be covered with plastics material or alloy skin so as to define inner spaces which may be used to accommodate cargo, stowage, fuel, engines, passenger spaces, and so on.

It will also be understood that any suitable type of propulsion means is envisaged. For example, the water craft may be provided with an engine and/or jets, with sails, with propulsion means arranged to harness power from waves, and so on.

It will also be understood that the amount of fluid in the conduits may be varied so as to actively adjust the inclination of the chassis 78, to modify the response to roll-type and/or pitch-type forces, to raise or lower the chassis 78 according to the conditions, and so on.

For example, prior to initial movement of the water craft 77, sensors may be used to determine the inclination of the chassis 78 and appropriate modifications made to the amount of fluid in the hydraulic circuits so as to raise or lower or so as to make the chassis 78 relatively level. Also, for water craft 77 intended to travel at high speed as planing-type water craft, the pods 30, 34, 38, 42 may be lifted clear of the water so as to reduce drag at low speed. With such a planing-type water craft, the chassis 78 would be enclosed in a hull which operates as a displacement-type water craft at low speed and which lifts clear of the water at relatively high speed. With this type of water craft, the unsprung weight of the legs and pods should be as low as possible so that the legs and pods are able to move rapidly up and down during use. With displacement-type water craft such as yachts, the legs and pods should be relatively heavy but should be buoyant enough to hold the body of the water craft clear of the water during use. To achieve increased weight in the pods, auxiliary engines, generators and so on may be located in the side pods so as to provide extra weight to sides of the water craft to help prevent heeling over during use.

Figure 5:
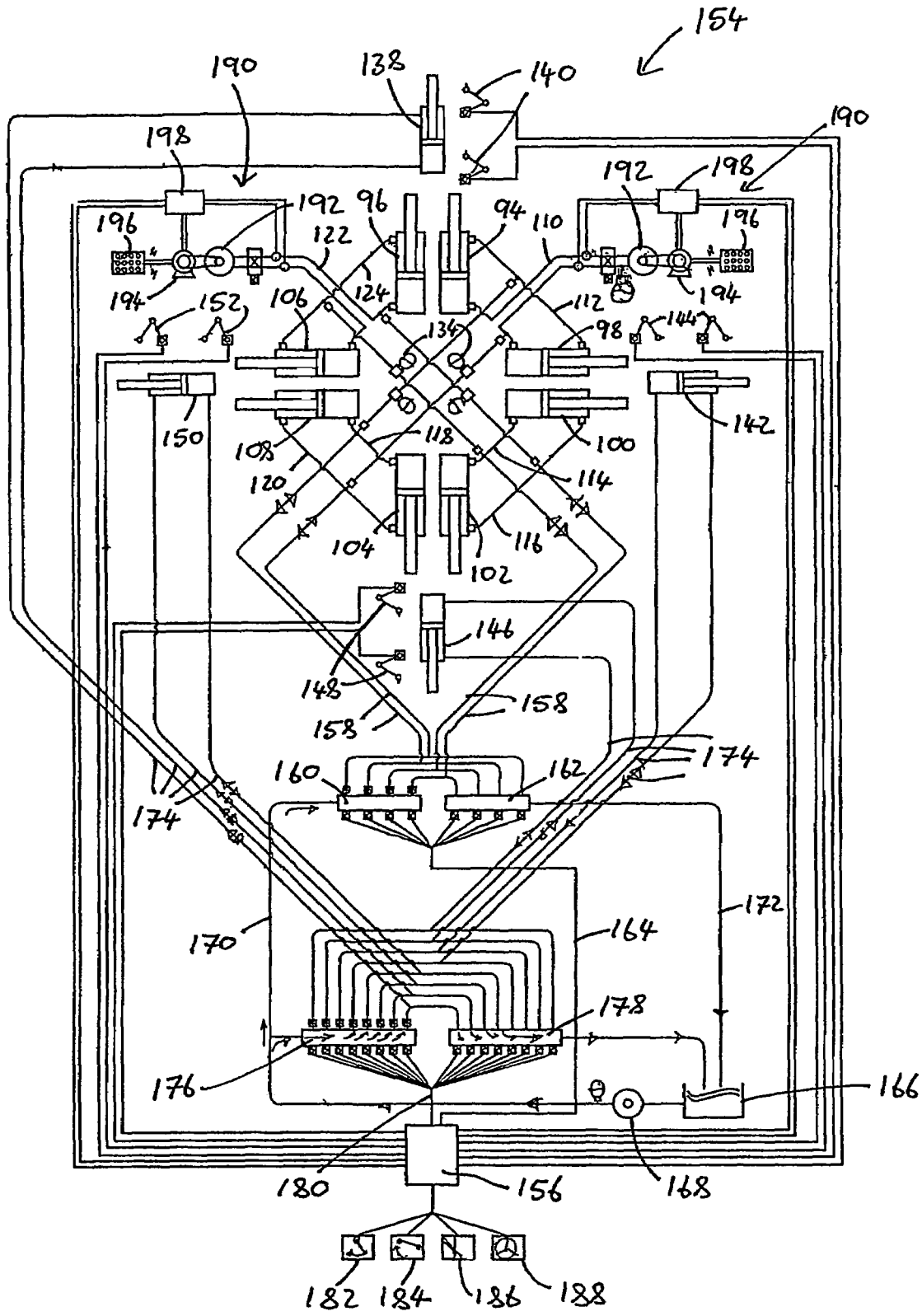
FIG. 5 is a schematic diagram illustrating a control circuit for the water craft shown in FIGS. 1 to 3.

Adjustments to the fluid in the hydraulic circuits may be carried out using a control circuit 154 as shown in FIG. 5.

The control circuit 154 includes a primary electronic control unit (ECU) 156 arranged to control the amount of fluid in the hydraulic circuits and thereby control the height and orientation of the chassis 77 and optionally the orientation of the pods 30, 34, 38, 42.

The control circuit 154 further includes control conduits 158 for transferring fluid to and from the hydraulic circuits interconnecting the leg rams, each control conduit 158 being connected in fluid communication to one of the link conduits 126, 128, 130, 132.

The control conduits 158 are also connected to a pressure manifold 160 and a return manifold 162. The pressure manifold 160 is arranged to selectively direct fluid to one or more of the control conduits 158 under control of the primary ECU 156 via first control lines 164. The return manifold 162 is arranged to selectively drain fluid from one or more of the control conduits 158 under control of the primary ECU 156 by the first control lines 164.

The pressure manifold 160 and the return manifold 162 are in circuit with a fluid tank 166 and a hydraulic pump 168. During use, fluid to be pumped into one or more of the control conduits 158 travels from the fluid tank 166 and through the pump 168 and a pressure conduit 170 to the pressure manifold 160. Similarly, during use fluid to be drained from one or more of the control conduits 158 travels from the return manifold 162 through a return conduit 172 to the tank 166.

In order to facilitate selectability of appropriate control conduits 158, the pressure manifold 160 and the return manifold 162 may be provided with valves controllable by the primary ECU 156. The valves may be of any suitable type, such as solenoid, poppet or spool valves.

The control circuit 154 also includes pod conduits 174 for transferring fluid to and from the pod rams 138, 142, 146, 150 so as to adjust the orientation of the pods relative to the legs as necessary. The pod conduits 174 are in fluid communication with a delivery manifold 176 and a return manifold 178, the delivery manifold 176 and the return manifold 178 being controllable by the primary ECU 156 so as to selectively direct fluid to and selectively drain fluid from chambers of the pod rams 138, 142, 146, 150.

The delivery manifold 176 and the return manifold 178 are disposed in circuit with the fluid tank 166 and the hydraulic pump 168. During use, fluid to be introduced into selected chambers of the pod rams travels from the fluid tank 166, and through the pump 168 and the delivery manifold 166 to the appropriate one or more of the pod conduits 174. Similarly, during use fluid to be drained from one or more of the chambers of the pod rams travels through an appropriate one or more of the pod conduits 174, through the return manifold 178 and into the tank 166.

In order to facilitate selectability of appropriate pod conduits 174, the delivery manifold 176 and the return manifold 178 may be provided with valves controllable by the primary ECU 156.

In order to determine the appropriate adjustment conduits 158 and pod conduits 174 in which to introduce fluid and from which to drain fluid, various sensors may be provided to determine the orientation of the water craft 77 and the forces exerted on the water craft. In this example, sensors include a lateral force sensor 182, a pitch force sensor 184, a yaw force sensor 186 and a steering position sensor 188. The primary ECU 156 also uses the pod position sensors 140, 144, 148, 152 to establish the current position of the pods.

The control circuit 154 also includes regenerative dampers 190 arranged to provide an adjustable level of damping under control of the primary ECU 156.

In this example, two regenerative dampers 190 are provided, each of the regenerative dampers 190 including a gear motor 192 connected in circuit with one of the upper conduits 110, 114, 118, 122 connecting upper chambers of an adjacent two leg rams. The gear motor is caused to turn when fluid is transferred between upper chambers of the adjacent rams. Mechanically connected to the gear motor 192 is an electrical generator 194 which generates electricity when a rotor of the generator 194 is turned. The output signal produced by the generator 194 is then rectified and regulated so as to provide a constant DC output voltage which is used to provide a recharge current for a battery 196. By controlling the magnitude of the recharge current, the level of damping can be controlled since the force required to rotate the rotor of the generator will increase as the recharge current increases. The magnitude of the recharge current may be controlled by a secondary ECU 198 or by the primary ECU 156. If the battery is fully charged, a resistor bank could be switched in to lose the excess power as heat. The battery could be used to power at least the electronics associated with the regenerative dampers 190, potentially the electronics associated with the control circuit 154, and/or bilge pumps, craft levelling pumps, small propulsion motors, and so on. The watercraft could be a buoy with no means of self-propulsion, but which remains anchored in position, using a regenerative damping system to generate electricity to power on-board systems, such as radio or light-emitting beacons for example.

Similarly, the water craft may be used as an alternative means of power generation, taking energy from pod motions caused by waves flowing under the pods, converting it and either storing the energy as electrical charge, fluid pressure or generating hydrogen gas or transferring the power direct to land. The water craft could have any number of pods, preferably six or more, and could be anchored in the ocean, just off shore, to provide a renewable energy source.

It will also be understood that other arrangements for providing an adjustable level of regenerative damping are possible. For example, an electro-mechanical damping arrangement could be incorporated into one or more of the hydraulic rams, the damping arrangement including a permanent magnet piston portion and a conductive coil portion provided within the cylinder of the hydraulic ram. The arrangement is such that as the piston moves relative to the coils, an electric current is generated which may be rectified, converted to DC and used to recharge a battery as with the above described regenerative damper 190. The number of coils, the density of the coils and the magnitude of the charge current would define the damping level. One possible modification to this arrangement is to replace the permanent magnet piston with a piston into which an excitation voltage is input, as is known in other applications.

Figure 6:
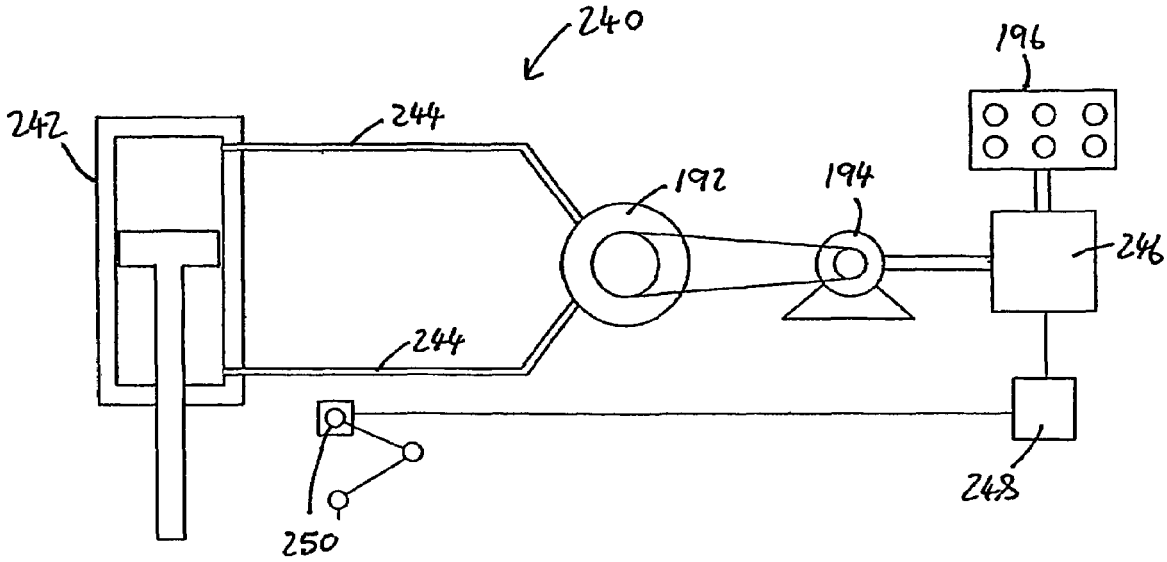
FIG. 6 is a schematic diagram illustrating a regenerative damper system for a water craft in accordance with the present invention.

Alternatively, a regenerative damper system may be provided wherein each of the pods have an additional associated regenerative damper 240 as shown in FIG. 6. Like features are indicated with like reference numerals.

The regenerative damper 240 includes a double acting ram 242 disposed between a leg and the chassis such that movement of the leg relative to the chassis during use effects compression or expansion of the ram 242. Chambers of the ram 242 are connected in fluid communication with a gear motor 192 using conduits 244 so that, during use, compression and expansion of the ram 242 causes fluid to flow through the conduits 244 and thereby the gear motor to rotate. An electrical generator 194 is in mechanical connection with the gear motor 192 and is caused to generate an electrical current when the gear motor 192 rotates. The electrical current produced by the generator 194 is supplied to a rectifier 246 which produces a full-wave rectified electrical current. The rectified current is supplied to a battery 196 as a battery recharge current. The magnitude of the charge current supplied by the rectifier 246 is adjustable using any suitable controllable regulator, the charge current magnitude being proportional to the force required to rotate the rotor of the generator 194 and to the level of damping produced by the regenerative damper 240.

The regenerative damper 240 also includes an electronic control unit (ECU) 248 and a position sensor 250, the position sensor 250 providing the ECU 248 with information indicative of the position of the respective pod. The ECU 248 may be arranged to control the regulator so as to modify the charge current magnitude and thereby the damping level using the information from the position sensor 250.

It will be understood that although a position sensor is shown in FIG. 6, other sensors may also be provided for sensing behaviour of the water craft or parts of the water craft during use, such as steering sensors, G-force sensors, and so on.

It will also be understood that by providing each pod with an associated regenerative damper 240 as shown in FIG. 6 and controlling the regenerative dampers using appropriate sensors and a single, common ECU 248, a regenerative damping system can be constructed for a water craft wherein the level of damping for each pod is individually controlled so as to selectively control pitch and roll motions of the water craft during use.

Figure 7:
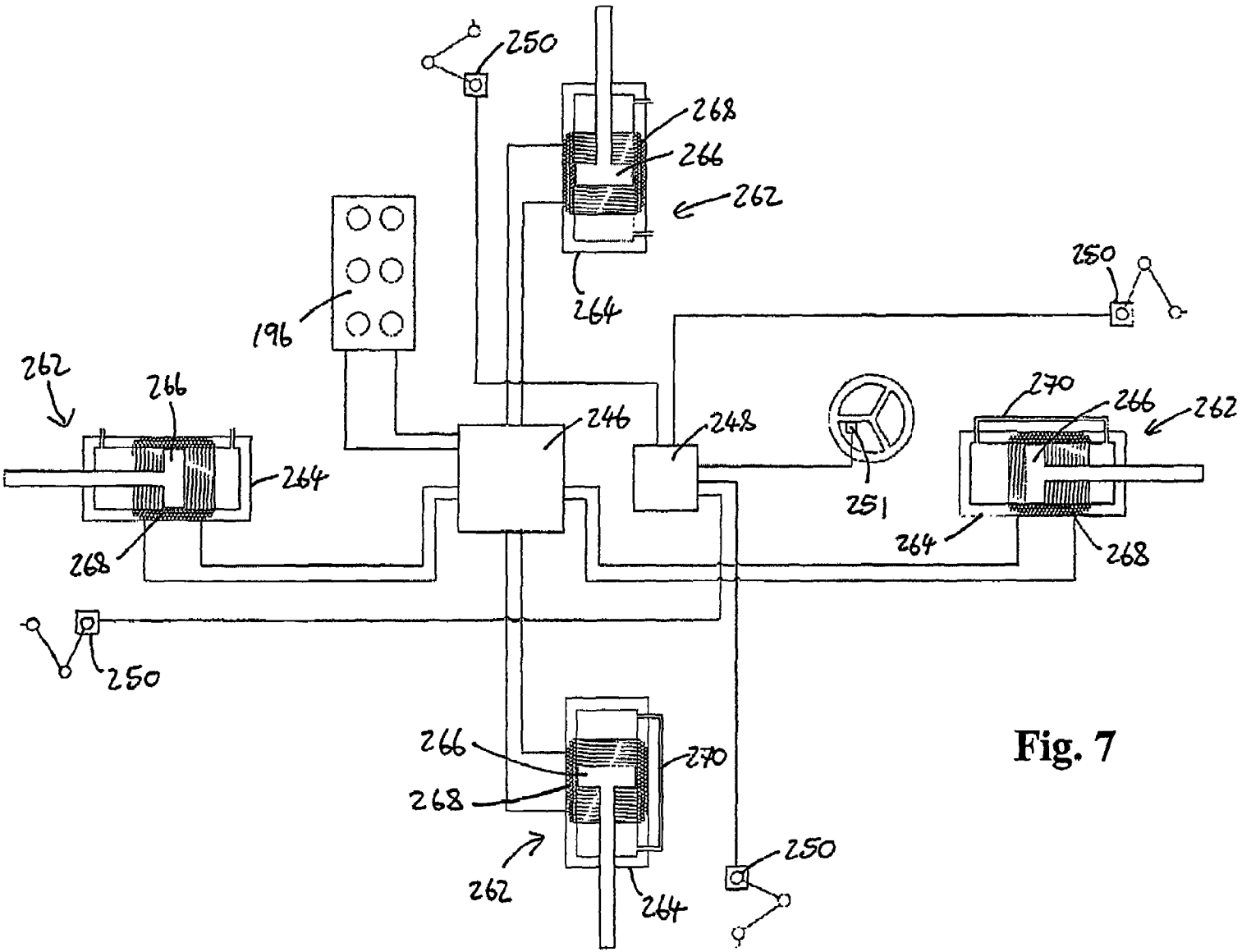
FIG. 7 is a schematic diagram illustrating an alternative regenerative damper system for a water craft in accordance with the present invention.

An alternative regenerative damper system 260 is shown in FIG. 7. Like features are indicated with like reference numerals. Operation of the alternative regenerative damper system 260 is essentially the same as operation of the regenerative damper system described in relation to FIG. 6 in that appropriate sensors and an ECU are used to achieve individual control of damping for each pod by modifying the magnitude of a rectified current generated as a result of expansion and contraction of a ram during use.

The alternative regenerative damper system 260 includes several alternative regenerative dampers 262. Each alternative damper 262 includes a double acting ram 264 having a permanent magnet piston head 266 or, as an alternative, a piston having a coil into which an excitation current is input. Wound around the ram 264 is an electrically conductive coil 268, in this example of copper material. Chambers of each ram 264 may be connected to each other through a bypass conduit 270 or may be open-ended so that chambers of the ram communicate with atmosphere. Alternatively, the unit may be externally sealed, but having internal connection between the two chambers through holes in the piston and no piston seal. Ends of the coil 268 are connected to a rectifier 246.

As with the regenerative damper system described above in relation to FIG. 6, each of the regenerative dampers 262 is disposed between a leg and the chassis so that, during use, movement of the respective leg relative to the chassis effects contraction or expansion of the regenerative damper 262. However, with the regenerative damper system 20 shown in FIG. 7, instead of expansion and contraction of the ram 264 driving a gear motor and a generator, in this example expansion and contraction of the ram 264 causes movement of the permanent magnet relative to the surrounding coil and thereby generation of an electrical current through the coil 268.

As with the regenerative damper system described above in relation to FIG. 6, any appropriate sensors may be provided, such as a position sensor 250 and a steering sensor 251, in order to sense the behaviour of the water craft or parts of the water craft during use.

As with the regenerative damping system described above in relation to FIG. 6, the level of damping provided by each regenerative damper 262 is selectable by modifying the magnitude of the charge current supplied to the battery 196, in this example the magnitude of the charge current being proportional to the magnitude of current drawn from the coils 268 and the magnitude of resistance to movement of the piston head relative to the coil.

As a further alternative, pod motions relative to the chassis may be used to pump fluid through a one way valve into a fluid storage device such as an accumulator, and compressed fluid stored in the storage device subsequently directed elsewhere as fluid power usable to drive components in the water craft, such as an electrical generator, bilge pumps, and so on.

Figure 8:
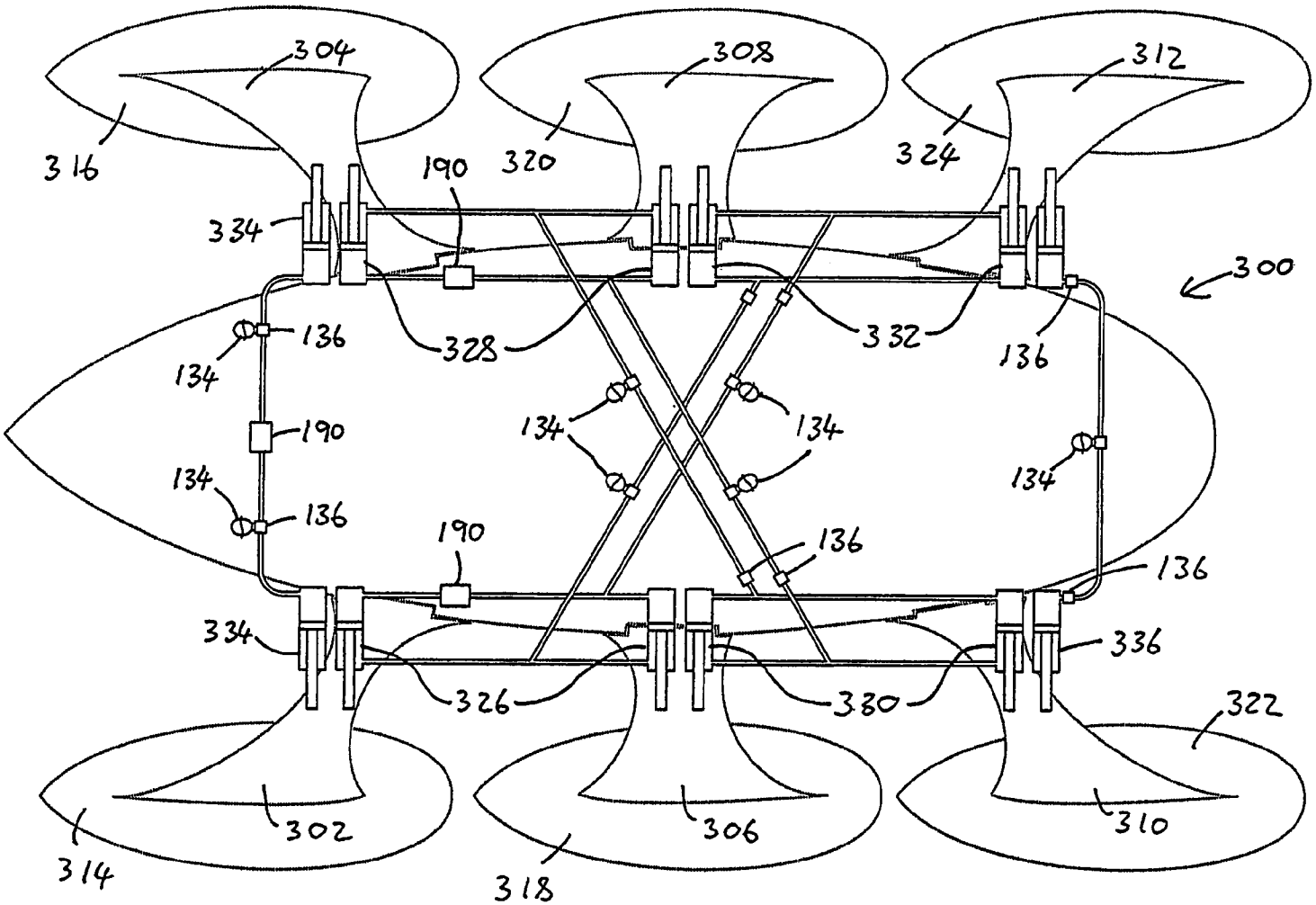
FIG. 8 is a diagrammatic plan view of a water craft in accordance with a further alternative embodiment of the present invention.

Referring to FIG. 8, there is shown a further alternative water craft 300 in accordance with a further alternative embodiment of the present invention. Like features are indicated with like reference numerals.

The water craft 300 operates in a similar way to the water craft shown in FIGS. 1 to 4 in that legs of the water craft are interconnected using hydraulic circuits so that roll and pitch motions of the water craft 300 are restricted without restricting individual motions of the legs.

However, unlike the embodiments shown in FIGS. 1 to 4, the water craft 300 includes six legs disposed in a rectangular configuration with two front legs 302, 304, two central legs 306, 308 and two rear legs 310, 312.

An end of a front left leg 302 is provided with a front left pod 314. An end of a front right leg 304 is provided with a front right pod 316. An end of a central left leg 306 is provided with a central left pod 318. An end of a central right leg 308 is provided with a central right pod 320. An end of a rear left leg 310 is provided with a rear left pod 322. An end of a rear right leg 312 is provided with a rear right pod 324.

Each of the legs is pivotably connected to a chassis portion (not shown) in any suitable way, for example using hinge connections as with the embodiment shown in FIGS. 1 to 4. If a single leg is used for each pod, a pod level ram may be provided as described in relation to the FIGS. 1 to 4 to control the rotational position of the pod relative to a pod hinge connection. Alternatively, each pod may be located relative to the chassis portion of the main hull 301 by more than one leg such that the pods can move in a vertical direction relative to the hull and such that the rotational position of each pod is controlled by the geometry of the more than one leg arrangement, which can in many applications negate the need for a pod level ram. Ideally, two legs are used for each pod in a double-wishbone type arrangement.

As with the embodiment shown in FIGS. 1 to 4, two rams 326, 328, 330, 332, 334, 336, in this example hydraulic rams, are flexibly connected between each leg and the chassis portion. Each adjacent pair of rams 326 and 330 of the left legs 302, 306, 310 and each adjacent pair of rams 328 and 332 of right legs 304, 308, 312 are connected together such that upper chambers of adjacent rams are connected together in fluid communication by respective front left upper, rear left upper, front right upper and rear right upper fluid conduits 338, 346, 342, 350 respectively and lower chambers of adjacent rams are connected together in fluid communication by respective front left lower, rear left lower, front right lower and rear right lower conduits 340, 348, 344 and 352 respectively. As a consequence of these interconnections 338, 340, 342, 344, 346, 348, 350, 352, movement of one of the legs in a generally vertical direction tends to cause movement of an adjacent leg in an opposite vertical direction and, in this way, the chassis (not shown) of the water craft 300 is encouraged to maintain a substantially stable inclination as the water craft progresses through an uneven water surface.

However, without additional interconnections, the above-described interconnections 338, 340, 342, 344, 346, 348, 350, 352 would provide similar stiffness for pure vertical displacements of all six pods as for roll displacements of the pods. In order to provide the ability to increase the roll stiffness of the arrangement, additional diagonal interconnections are provided. Front left upper conduit 338 is connected to the rear right lower conduit 352 by first diagonal conduit 354. Similarly, second diagonal conduit 356 connects the front right upper conduit 342 and the rear left lower conduit 348, third diagonal conduit 358 connects the rear left upper conduit 346 and the front right lower conduit 344 and fourth diagonal conduit 360 connects the rear right upper conduit 350 and the front left lower conduit 340.

Figure 9:
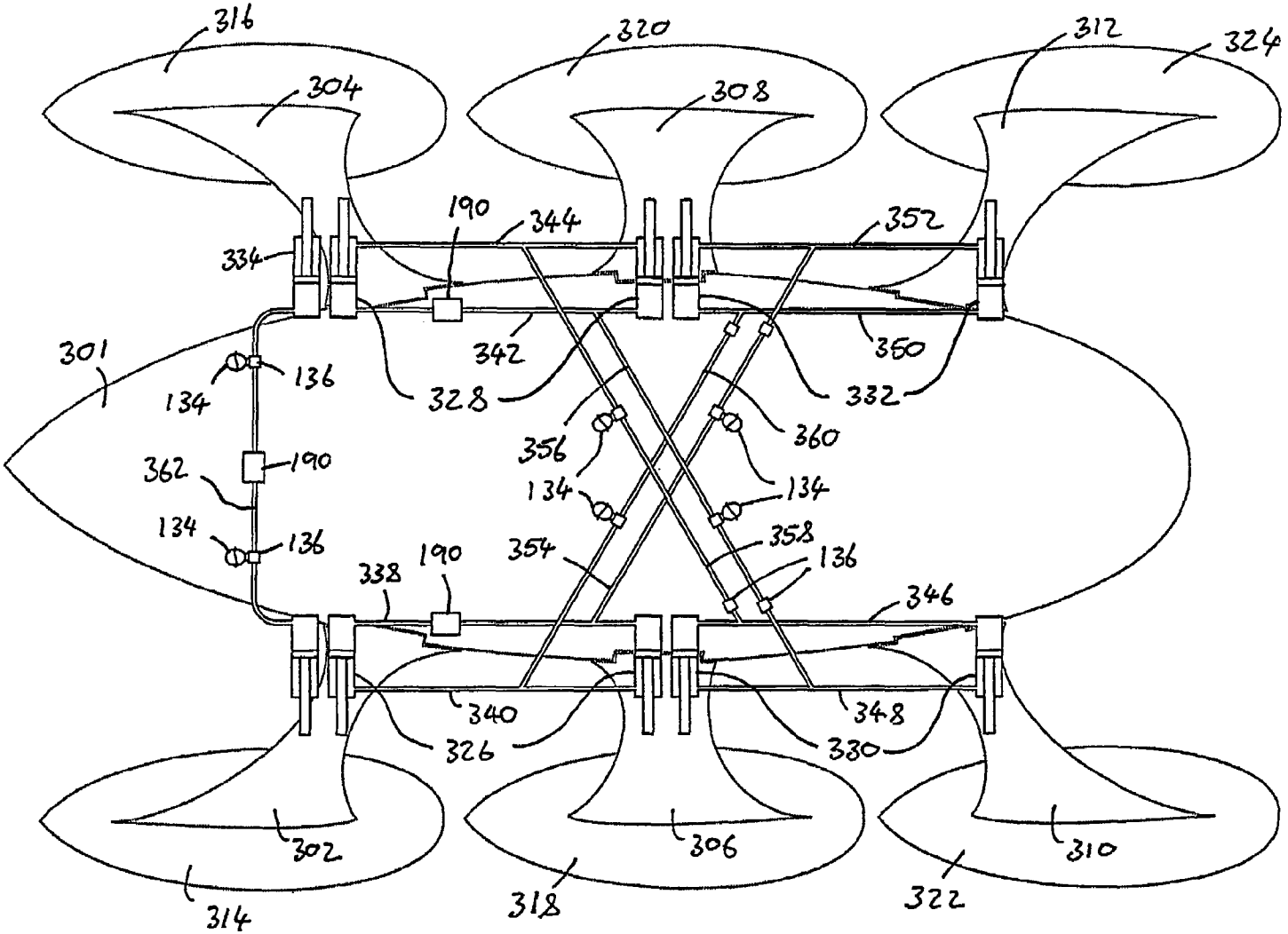
FIG. 9 is a diagrammatic plan view of a water craft in accordance with a further alternative embodiment of the present invention.

This arrangement can still have excessively low pitch stiffness, so, as shown in FIG. 8, the upper chambers of the frontmost pair of rams 334 associated with the front legs 302, 304, can be filled with fluid and connected together in fluid communication by front conduit 362. Similarly, the upper chambers of the rearmost pair of rams 336 associated with the rear legs 310, 312, can be filled with fluid and connected together in fluid communication by rear conduit 364. One disadvantage of providing additional pitch stiffness using a frontmost pair of rams and a rearmost pair of rams is that as the watercraft negotiates a wave head-on, when the pair of central pods 318 and 320 are in a trough, they can become unweighted. Hence this arrangement does not provide constant loading on all pods over all shapes of water surface. A partial solution to this issue is to delete one of either the frontmost or rearmost pairs of rams as shown in FIG. 9. It should be understood that it can be desirable to delete both the frontmost pair of rams and the rearmost pair of rams if the low pitch stiffness this provides is suitable for the layout and application of a particular vessel.

A further embodiment which provides an alternative solution to this issue is shown in FIG. 10. The arrangement shown in FIG. 10 is similar to the arrangement shown in FIG. 8, in that two rams per pod are provided and similar interconnections are included which are labelled with like reference numerals. The adjacent pair of rams 326 of the left legs 302, 306 and the adjacent pair of rams 328 of the right legs 304, 308 are similarly connected together such that upper chambers of adjacent rams are connected together in fluid communication by respective front left upper and front right upper conduits 338, 342 respectively and lower chambers of adjacent rams are connected together in fluid communication by respective front left lower and front right lower conduits 340 and 344 respectively. The rearmost pair of rams 336 are now double-acting rams with the respective upper and lower chamber of the rearmost ram on the rear left leg 310 being in fluid communication with the respective upper and lower chambers of the adjacent pair of rams of the other two left legs 302, 306 through respective rearmost left upper and rearmost left lower conduits 370, 372 respectively. Similarly, the respective upper and lower chambers of the rearmost ram on the rear right leg 312 are in fluid communication with the respective upper and lower chambers of the adjacent pair of rams of the other two right legs 304, 308 through respective rearmost right upper and rearmost right lower conduits 374, 376 respectively. The upper chambers of ram pair 326 and of rearmost ram 336 on the left side of the watercraft are in fluid communication with the lower chambers of ram pair 328 and of rearmost ram 336 on the right side of the watercraft through a first lateral conduit 378. The upper chambers of ram pair 328 and of rearmost ram 336 on the right side of the watercraft are in fluid communication with the lower chambers of ram pair 326 and of rearmost ram 336 on the left side of the watercraft through a second lateral conduit 380.

The above-described interconnections 338, 340, 342, 344, 370, 372, 374, 376, 378 and 380 provide for a bounce stiffness, a higher roll stiffness and no pitch stiffness. They also permit the static load on each pod to remain constant over any undulating water surface.

To provide further bounce stiffness and a pitch stiffness, the upper chambers of the frontmost pair of rams 334 associated with the front legs 302, 304, are again connected together in fluid communication by front conduit 362. Also, the adjacent pair of rams 330 of the left legs 306, 310 and the adjacent pair of rams 332 of the right legs 308, 312 are connected together such that upper chambers of adjacent rams are connected together in fluid communication by respective rear left upper and rear right upper conduits 346, 350 respectively. The rear left upper and rear right upper conduits 346, 350 are in fluid communication through a third lateral conduit 382. The interconnection of ram pair 334 provides front support and the interconnection of both ram pairs 330 and 332 provides rear support, the front and rear support being provided in a manner which permits the static load on each pod to remain constant over any undulating water surface.

The further embodiment shown in FIG. 10 therefore provides a stable attitude of the hull and constant static loads on each pod over any undulating water surface.

If the rod and bore dimensions of all rams are similar and the geometry of all legs is similar, then the embodiment shown in FIG. 10 will be most suitable for a sail powered watercraft as the pitch centre is behind the centre pods 306 and 308. However, for a power boat application, the arrangement can be reversed, i.e. the hydraulic system can be mirrored front to rear to improve stability when the means of propulsion is below the mass centre of the watercraft.

In FIGS. 8, 9 and 10, as with the embodiments shown in FIGS. 1 to 4, accumulators 134 and damper valves 136 are provided so as to provide a degree of resilience to rapid pod motions and to resolve spike loads.

Although three alternative configurations of a six pod watercraft system have been described with respect to FIGS. 8 to 10, it will be understood that other variations are possible.

It will also be understood that although the embodiments shown in FIGS. 8 to 10 are described in relation to a water craft having six pods and associated legs arranged in a rectangular configuration, other variations are possible, such as a water craft with eight pods and associated legs.

It will also be understood that other features which are discussed above in relation to the embodiments shown in FIGS. 1 to 4 and which are applicable to the embodiments shown in FIGS. 8 to 10 may also be included where appropriate. For example, regenerative dampers 190 may be included to provide an adjustable level of damping control.

Modifications and variations as would be apparent to a skilled addressee are deemed to be within the scope of the present invention.

The invention claimed is:

1. A water craft including a chassis portion, at least four water engaging means and interconnection means, each water engaging means being connected to the chassis portion and being moveable in a substantially vertical direction relative to the chassis portion, the interconnection means including a plurality of rams and a plurality of fluid conduits, each ram being disposed between a water engaging means and the chassis portion and each ram being fluidly connected to at least one other ram associated with at least one other water engaging means using at least one fluid conduit; and the interconnection means being arranged to functionally link the at least four water engaging means such that simultaneous movement of all water engaging means is permitted when adjacent water engaging means move in opposite substantially vertical directions, and such that when two adjacent water engaging means are urged during use to move in the same substantially vertical direction relative to the chassis portion, an opposite two adjacent water engaging means are restricted from moving in a substantially opposite vertical direction relative to the chassis portion, and the chassis portion is thereby encouraged to maintain an orientation which is substantially constant relative to the average plane of the water surface;

characterized in that the water craft further comprises means for controlling the orientation of the water engaging means relative to the average plane of the water surface during use.

2. A water craft as claimed in claim 1, wherein the interconnection means is arranged to functionally link the water engaging means such that, for any loading condition, the static load on each water engaging means remains substantially constant even when the water engaging means are not all disposed in the same plane.

3. A water craft as claimed in claim 1, wherein the interconnection means is arranged to functionally link the water engaging means such that statically the proportion of weight borne by a first pair of oppositely located water engaging means relative to the weight borne by a second pair of oppositely located water engaging means is substantially constant.

4. A water craft as claimed in claim 1, wherein each water engaging means is associated with two rams, each ram being fluidly connected to a ram associated with an adjacent water engaging means.

5. A water craft as claimed in claim 1, wherein the water engaging means are disposed in a diamond shaped configuration relative to the chassis portion when viewed in plan.

6. A water craft as claimed in claim 1, wherein the water engaging means are disposed in a rectangular shaped configuration relative to the chassis portion when viewed in plan.

7. A water craft as claimed in claim 6, wherein the interconnection means is arranged to functionally link the water engaging means such that when two adjacent water engaging means disposed on a first lateral side of the water craft are urged during use to move in a substantially upward vertical direction relative to the chassis portion, two adjacent water engaging means disposed on a second opposite lateral side of the water craft are restricted from moving in a substantially downward vertical direction relative to the chassis portion, thereby supporting the first and second lateral sides of the water craft in a roll axis.

8. A water craft as claimed in claim 7, wherein the rams and fluid conduits define a plurality of discrete fluid circuits, at least some of the fluid circuits including a first fluid conduit extending between upper chambers of a first pair of adjacent rams disposed on a first lateral side of the water craft, a second fluid conduit extending between lower chambers of a second pair of adjacent rams disposed on a second opposite lateral side of the water craft, and a third fluid conduit extending between the first fluid conduit and the second fluid conduit.

9. A water craft as claimed in claim 6, comprising at least six water engaging means at least three water engaging means being disposed on a first lateral side of the water craft and at least three water engaging means being disposed on a second opposite lateral side of the water craft.

10. A water craft as claimed in claim 8, comprising at least six water engaging means at least three water engaging means being disposed on a first lateral side of the water craft and at least three water engaging means being disposed on a second opposite lateral side of the water craft, wherein the third fluid conduit extends between a first fluid conduit of a first pair of adjacent rams disposed on the first lateral side of the water craft and a second fluid conduit of a transversely located pair of adjacent rams disposed on a second opposite lateral side of the water craft.

11. A water craft as claimed in claim 8 comprising at least six water engaging means at least three water engaging means being disposed on a first lateral side of the water craft and at least three water engaging means being disposed on a second opposite lateral side of the water craft, wherein the third fluid conduit extends between a first fluid circuit portion of a first pair of adjacent rams disposed on the first lateral side of the water craft and a second fluid conduit of a diagonally located pair of adjacent rams disposed on a second opposite lateral side of the water craft.

12. A water craft as claimed in claim 1, further comprising a front left ram, a front right ram, and a front fluid conduit extending between the front left ram and the front right ram, the front left ram, the front right ram and the front fluid conduit defining a front fluid circuit which supports a front portion of the water craft in a pitch axis.

13. A water craft as claimed in claim 1, further comprising a rear left ram, a rear right ram, and a rear fluid conduit extending between the rear left ram and the rear right ram, the rear left ram, the rear right ram and the rear fluid conduit defining a rear fluid circuit which supports a rear portion of the water craft in a pitch axis.

14. A water craft as claimed in claim 1, further including at least one accumulator in fluid communication with at least one of the fluid conduits, each accumulator being arranged to absorb rapid movements of at least one of the water engaging means during use.

15. A water craft as claimed in claim 1, further comprising sensors usable to determine the orientation of the chassis portion relative to the water engaging means, and means for controlling the position of the water engaging means relative to the chassis portion in response to the sensors.

16. A water craft as claimed in claim 1, further comprising means for actively controlling the orientation of the chassis portion so as to modify the response of the water craft according to conditions during use.

17. A water craft as claimed in claim 16, wherein the means for actively controlling the orientation of the chassis portion is arranged to modify the response of the water craft to roll type forces according to conditions during use.

18. A water craft as claimed in claim 16, wherein the means for actively controlling the orientation of the chassis portion is arranged to modify the response of the water craft to pitch type forces according to conditions during use.

19. A water craft as claimed in claim 16, wherein the means for actively controlling the orientation of the chassis portion is arranged to raise or lower the chassis portion of the water craft according to conditions during use.

20. A water craft as claimed in claim 15, further comprising an electronic control unit (ECU) arranged to control the amount of fluid in the fluid circuits and thereby control the height and orientation of the chassis portion relative to the water engaging means.

21. A water craft as claimed in claim 1, further including at least one damper valve arranged to restrict fluid flow between interconnected rams.

22. A water craft as claimed in claim 21, wherein at least one damper valve is a controllable damper valve arranged to provide an adjustable level of damping.

23. A water craft as claimed in claim 22, wherein the controllable damper valve is arranged such that fluid flow through a fluid circuit during use effects relative movement between a magnetic member and a coil and thereby generation of an electrical current, the degree of damping provided by the controllable damper valve being proportional to the magnitude of electrical power drawn from the coil.

24. A water craft as claimed in claim 23, wherein the controllable damper valve includes a gear motor in circuit with a fluid circuit, the gear motor being arranged to turn when fluid flows in the fluid circuit, and a generator having a rotor caused to rotate when the gear motor rotates so as to thereby generate an electrical current.

25. A water craft as claimed in claim 24, wherein the controllable damper valve includes a piston portion and a cylinder portion, one of the piston portion and the cylinder portion being arranged to generate a magnetic field and the other of the piston portion and the cylinder portion including a coil, the piston portion being arranged to move relative to the cylinder portion when fluid flows in the fluid circuit so as to thereby generate an electrical current in the coil.

26. A water craft as claimed in claim 1, wherein the means for controlling the orientation of the water engaging means includes at least one control ram.

27. A water craft as claimed in claim 26, wherein the means for controlling the orientation of the water engaging means includes at least one sensor arranged to sense a parameter associated with operation of the water craft and to cause expansion or contraction of at least one control ram in response to the at least one sensor.

28. A water craft as claimed in claim 27, wherein the parameter associated with operation of the water craft is lateral force, pitch force, yaw force, or steering position.

29. A water craft as claimed in claim 1, wherein at least one of the water engaging means is connected to the chassis portion such that the water engaging means is arranged to tilt when the water engaging means moves in a substantially vertical direction relative to the chassis portion during use.

30. A water craft as claimed in claim 1, wherein at least one of the water engaging means is connected to the chassis portion using mechanical linkage means arranged to cause the water engaging means to tilt when the water engaging means moves in a substantially vertical direction relative to the chassis portion during use.

31. A water craft as claimed in claim 30, wherein the linkage means comprises a double wishbone.

32. A water craft as claimed in claim 1, wherein the water craft is arranged to facilitate movement of all water engaging means away from contact with the water during use so as to reduce drag at low speed.

33. A water craft as claimed in claim 1, wherein at least one of the water engaging means includes an underside surface arranged to contact the water surface during use, the underside surface being contoured so as to restrict side slippage of the water craft during use.

34. A water craft as claimed in claim 1, further including at least one damping means arranged to absorb energy from motions of at least one water engaging means relative to the chassis.

35. A water craft as claimed in claim 34, wherein each damping means is associated with a water engaging means and each damping means includes a first damping member and a second damping member arranged to move relative to the first damping member when the water engaging means moves relative to the chassis, the damping means being arranged such that relative movement between the first damping member and the second damping member effects relative movement between a magnetic member and a coil and thereby generation of an electrical current, the degree of damping provided by the damping means being proportional to the magnitude of electrical power drawn from the coil.

36. A water craft as claimed in claim 35, wherein the damping means includes a piston portion and a cylinder portion, one of the piston portion and the cylinder portion being arranged to generate a magnetic field and the other of the piston portion and the cylinder portion including a coil, the piston portion being arranged to move relative to the cylinder portion when a water engaging means moves relative to the chassis portion so as to thereby generate an electrical current in the coil.

37. A water craft as claimed in claim 36, wherein the damping means includes a fluid pump and a fluid storage device, the fluid pump being arranged to transfer fluid to the fluid storage device when a water engaging means moves relative to the chassis portion.

38. A water craft as claimed in claim 34, further including energy storage means arranged to store at least a portion of the energy absorbed by the damping means.

39. A water craft as claimed in claim 38, wherein the energy storage means includes a battery.

* * * * *

UNITED STATES PATENT AND TRADEMARK OFFICE

CERTIFICATE OF CORRECTION

PATENT NO. : 7,314,014 B2
APPLICATION NO. : 10/524499
DATED : January 1, 2008
INVENTOR(S) : Christopher Brian Heyring It is certified that error appears in the above-identified patent and that said Letters Patent is hereby corrected as shown below:

Col. 17 line 24, please replace the term "composes" with "comprises".

Col. 18 line 9, please replace the term "tree" with "three".

Signed and Sealed this

Fifteenth Day of September, 2009

David J. Kappos

David J. Kappos
*Director of the United States Patent and Trademark Office*